US007926469B2

(12) United States Patent
Millet et al.

(10) Patent No.: US 7,926,469 B2
(45) Date of Patent: Apr. 19, 2011

(54) FUEL INJECTOR ASSEMBLY AND INTERNAL COMBUSTION ENGINE COMPRISING SUCH AN ASSEMBLY

(75) Inventors: Guillaume Millet, Lyons (FR); Mourad Hedna, Lyons (FR)

(73) Assignee: Renault Trucks, Saint Priest (FR)

( * ) Notice: Subject to any disclaimer, the term of this patent is extended or adjusted under 35 U.S.C. 154(b) by 560 days.

(21) Appl. No.: 11/917,963

(22) PCT Filed: Jun. 28, 2005

(86) PCT No.: PCT/EP2005/007899

§ 371 (c)(1),
(2), (4) Date: Apr. 16, 2008

(87) PCT Pub. No.: WO2007/000182

PCT Pub. Date: Jan. 4, 2007

(65) Prior Publication Data

US 2010/0037862 A1 Feb. 18, 2010

(51) Int. Cl.
*F02M 37/04* (2006.01)

(52) U.S. Cl. ..... 123/509; 123/511; 123/447; 239/88

(58) Field of Classification Search ..... 123/446, 123/447, 506, 509, 510, 511; 239/88–96
See application file for complete search history.

(56) References Cited

U.S. PATENT DOCUMENTS

| | | | | |
|---|---|---|---|---|
| 4,784,101 | A * | 11/1988 | Iwanaga et al. | 123/446 |
| 5,176,120 | A * | 1/1993 | Takahashi | 123/467 |
| 5,326,034 | A * | 7/1994 | Peters | 239/90 |
| 6,227,166 | B1 * | 5/2001 | Mack | 123/446 |
| 6,439,202 | B1 | 8/2002 | Carroll, III et al. | |
| 6,513,497 | B1 | 2/2003 | Mahr et al. | |
| 6,845,754 | B2 * | 1/2005 | Pecheny et al. | 123/446 |

FOREIGN PATENT DOCUMENTS

WO 2004033893 A1 4/2004

* cited by examiner

*Primary Examiner* — Thomas N Moulis
(74) *Attorney, Agent, or Firm* — Novak Druce + Quigg LLP

(57) ABSTRACT

This fuel injector assembly (1) is used to inject fuel into a combustion chamber (52) of an engine. It comprises a needle control unit (14) adapted to actuate a needle (15) to deliver fuel to the chamber (52), an amplifier unit (13) adapted to increase the pressure of a quantity of fuel coming from an accumulator (3) of fuel under pressure and a cam (4) driven feeder unit (12) adapted to feed the accumulator (3) with fuel under pressure. No external pump is needed to feed the accumulator (3).

27 Claims, 5 Drawing Sheets

FUEL INJECTOR ASSEMBLY AND INTERNAL COMBUSTION ENGINE COMPRISING SUCH AN ASSEMBLY

TECHNICAL FIELD OF THE INVENTION

This invention concerns a fuel injector assembly for injecting fuel into a combustion chamber of an engine. This invention also concerns an engine including at least such an assembly.

BACKGROUND OF THE INVENTION

In order to inject fuel into the combustion chambers of an internal combustion engine, it is known to use fuel injectors mounted onto the cylinder heads of the engine and including a needle control unit adapted to control the flow of fuel towards each chamber, so as to obtain the desired rate shaping of fuel injection.

The use of an accumulator, where fuel is stored under pressure, to feed fuel injectors enables to inject fuel into combustion chambers without being dependent on the angle of rotation of a cam shaft.

As mentioned in WO-A-2004/033893, an injector can be fed with fuel under relatively high pressure from an accumulator which is charged by a high pressure pump driven by the engine. This injector includes an amplifier adapted to increase the pressure of the fuel coming from the accumulator and a needle control unit adapted to actuate a needle which delivers fuel to a combustion chamber. The high pressure pump must be implemented on the engine, together with long high pressure lines between this pump and the accumulator. This pump and these long lines are exposed to very high pressure and constitute sources of potential leakage which are not easy to handle. This is a problem for the reliability of the injection system.

SUMMARY OF THE INVENTION

Today, one needs an injector assembly which will allow injection of fuel under high pressure, with rate shaping and multiple injection capabilities on the whole engine range.

The invention aims at providing a fuel injector assembly which can be fed from an accumulator but which does not imply the use of an external feeding pump for such an accumulator and where leakage risks are highly reduced.

The invention concerns a fuel injector assembly for injecting fuel into a combustion chamber of an engine, this assembly comprising a needle control unit adapted to actuate a needle to deliver fuel to the chamber, an amplifier unit adapted to increase the pressure of a quantity of fuel coming from an accumulator of fuel under pressure, wherein this assembly also includes a cam driven feeder unit adapted to feed the accumulator with fuel under pressure.

Thanks to the invention, the cam driven feeder unit of the injector assembly can be used to accumulate fuel under pressure into the storage capacity of the accumulator, which implies that no external pump is needed. High pressure injection can thus be achieved with a possibility of rate shaping and multiple injection, whereas the risks of leakage are reduced. In particular, no long high pressure lines are needed and potential leakage problems are concentrated in one area. The assembly is compact and easily adaptable to an engine. The load on the drive train is low, which improves the global output of the engine.

According to further aspects of the invention, a fuel injector according to the invention might incorporate one or several of the following features:

The needle control unit, the amplifier unit and the feeder unit are integrated in a structural body adapted to be mounted onto a cylinder head of an engine. Preferably, this structural body is divided into a first part, which includes the feeder unit, and a second part, which includes the amplifier and needle control units.

The feeder unit includes a piston adapted to be driven by a cam shaft of an engine and sliding within a volume connected, on the one hand, to a source of fuel at low pressure and, on the other hand, to the accumulator. A control valve is advantageously interposed between the fuel source and the volume where the piston slides.

The amplifier unit includes a piston sliding within a primary volume connected to the accumulator and to the needle control unit. A control valve is advantageously connected to the amplifier unit and to the needle control unit, this valve being adapted to control both amplification in the amplifier unit and needle lift. This control valve can be connected to the accumulator and to a secondary volume of the amplifier unit which is used to control sliding of the piston within the primary volume, throttle means being installed at least on one connecting line between the control valve and the accumulator or between the control valve and the secondary volume. Throttle means can also be installed on a connecting line between the control valve and the needle unit.

When a structural body is used as mentioned here above, the control valve or valves can be integrated in such a body.

The invention also concerns an internal combustion engine comprising at least a combustion chamber and at least a fuel injector assembly as mentioned here above, such an assembly being adapted to inject fuel into this chamber.

According to some advantageous aspects of the invention, such an engine might incorporate one or several of the following technical features:

It is provided with several combustion chambers, each chamber being equipped with at least a fuel injector assembly, some assemblies being as mentioned here above, whereas some other assemblies include a needle unit and an amplifier unit, but no feeder unit.

An accumulator is fed by the feeder units of fuel injector assemblies which include such a unit, whereas this accumulator is connected to the amplifier units of all fuel injector assemblies. The accumulator can be formed by a rail mounted on the cylinder heads of the combustion chambers of the engine.

BRIEF DESCRIPTION OF THE DRAWINGS

The invention will be better understood on the basis of the following description which is given in correspondence with the annexed figures and as an illustrative example, without restricting the object of the invention. In the annexed figures.

DETAILED DESCRIPTION OF SOME EMBODIMENTS

Figure 1:
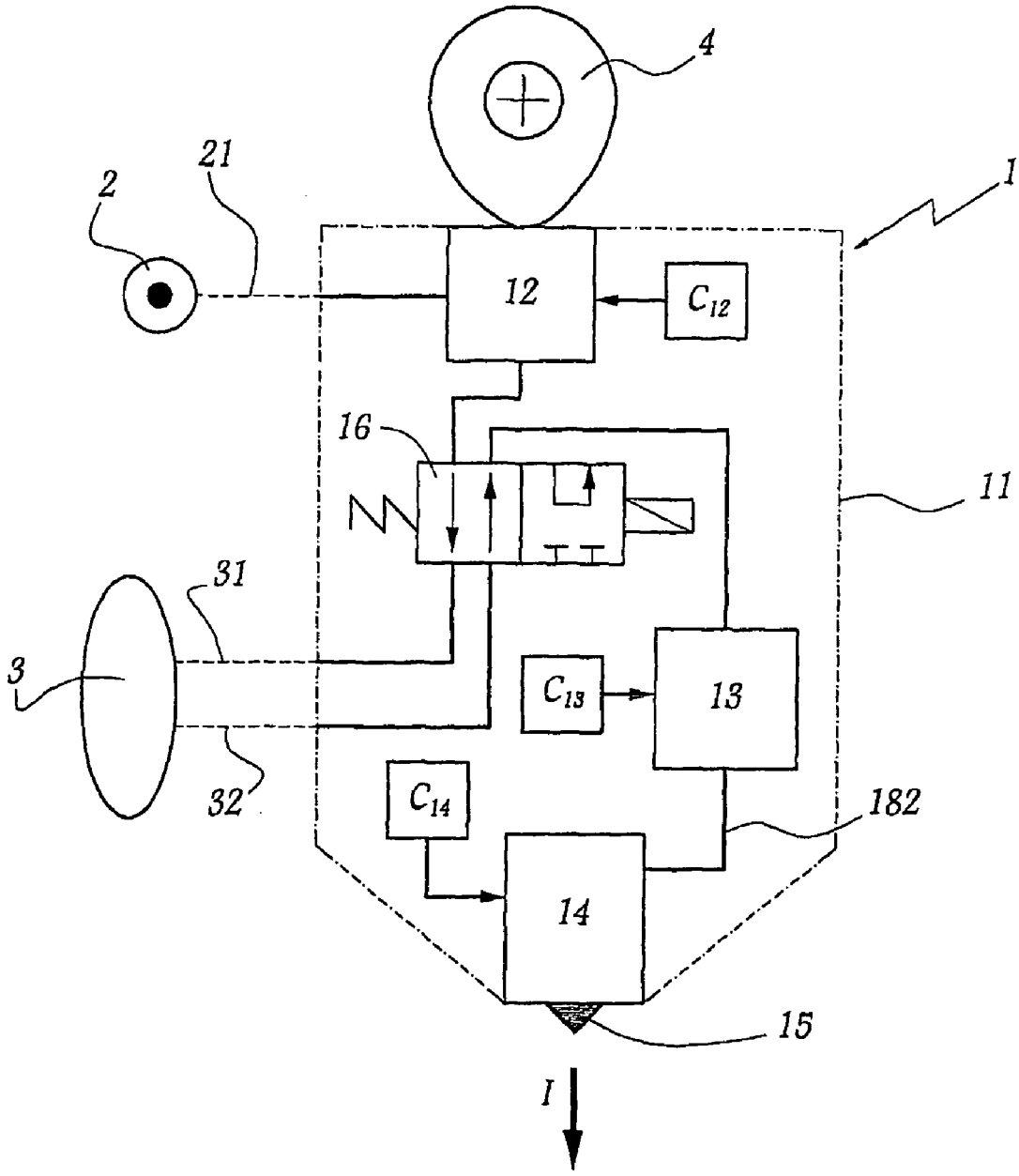
FIG. 1 is a flow diagram of a fuel injector assembly according to a first embodiment of the invention.

The fuel injector assembly 1 shown on FIG. 1 includes a structural body 11 to be mounted onto a cylinder head of an internal combustion engine which is not shown. This body is functionally represented on FIG. 1. Assembly 1 is connected by a connecting line 21 to a source 2 of fuel at low pressure $P_1$, preferably in the range of about $5.10^5$ Pa pressure, for example the tank of an automotive vehicle.

Assembly 1 is also connected to an accumulator 3 adapted to contain fuel under a relatively high pressure $P_2$, namely fuel with a pressure higher than $5.10^7$ Pa. A first connecting line 31 connects assembly 1 to accumulator 3 for the flow of fuel from assembly 1 to accumulator 1. A second connecting line 32 connects accumulator 3 to assembly 1 for flow in the reverse direction.

Assembly 1 includes a first unit 12 adapted to be driven by a crank shaft 4 of the engine on which the assembly 1 is mounted. Assembly 1 also includes an amplifier unit 13 and a needle control unit 14 which drives a needle 15 whose lift allows to deliver fuel under pressure inside a combustion chamber, this fuel coming from the amplifier unit 13 via a connection line 182. Injection is represented by arrow I on the figures. A servo-valve 16 is mounted between feeder unit 12 and amplifier unit 13 and mobile between two positions.

In its first position shown on FIG. 1, valve 16 allows circulation of fluid, under pressure $P_2$, from first unit 12 to accumulator 3, via line 31, and circulation of fuel, at about the same pressure, from accumulator 3 to amplifier unit 13, via line 32. In its second position, control valve 16 directly connects feeder unit 12 to amplifier unit 13 and isolates accumulator 3 from units 12, 13 and 14.

Pressure of fuel coming from accumulator 3 or directly from feeder unit 12 is raised in the amplifier 13 from $P_2$ to a high pressure value $P_3$, which is at least twice $P_2$.

Three controllers $C_{12}$, $C_{13}$ and $C_{14}$ are used to pilot units 12, 13 and 14 according to the desired operating mode. These controllers can be servo-valves or electrical actuators.

When valve 16 is in the position shown on FIG. 1, fuel at a pressure $P_2$ is available for amplifier unit 13 at every moment, independently of the position of crank shaft 4, which enables an injection I of fuel in the combustion chamber of an engine at any moment. Therefore, the injection rate, the instantaneous fuel flow and the injection rate shaping can be designed and implemented according to the needs, without limitation due to the position of a crank shaft. On the other hand, no high pressure pump is needed to feed accumulator 3 since feeder unit 12 fulfils this function.

In this embodiment, valve 16 functions as a switch on the downstream side of feeder unit 12. Fuel at $P_2$ is either directed to accumulator 3 or directly to amplifier unit 13.

Figure 2:
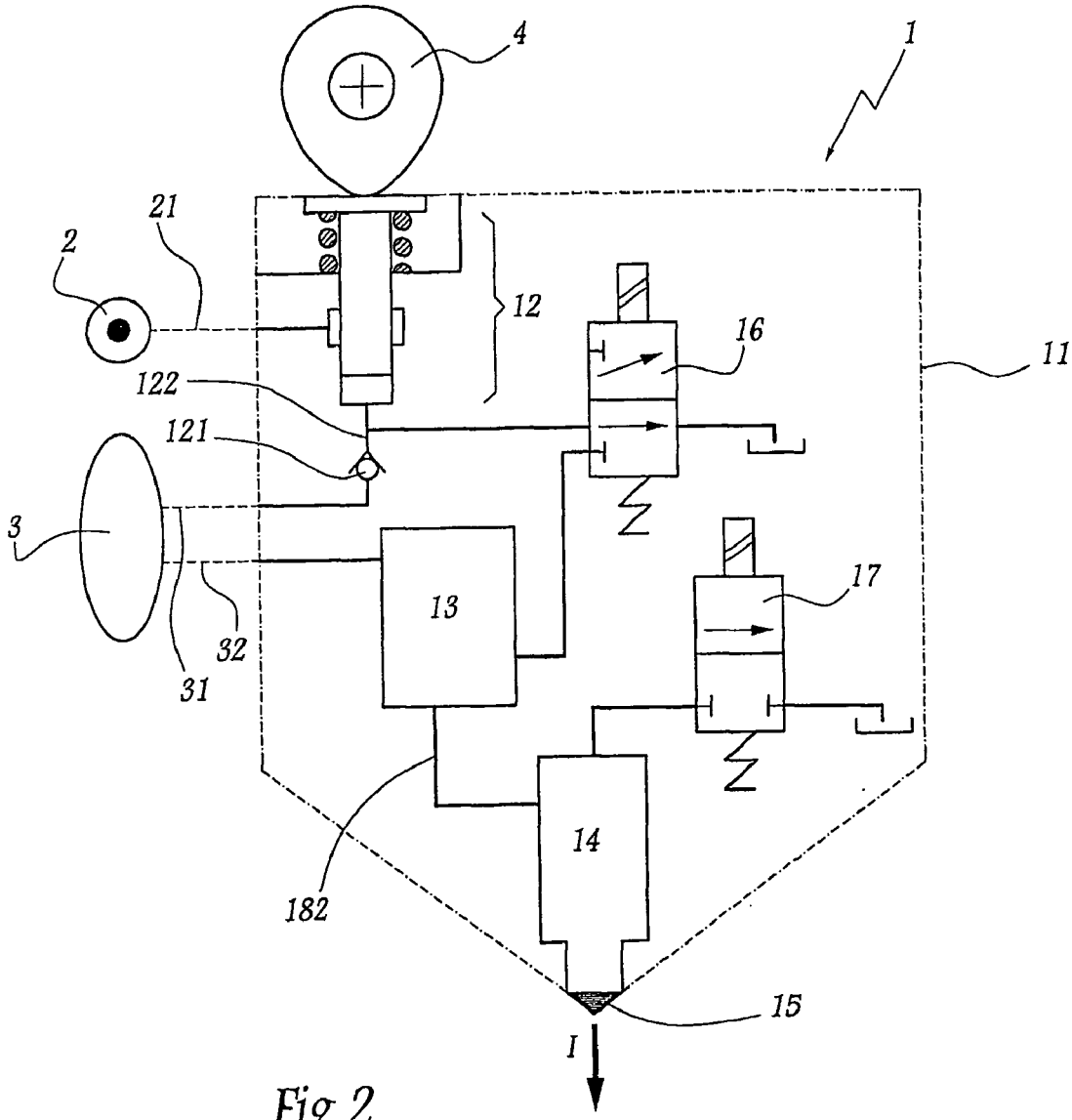
FIG. 2 is a flow diagram similar to FIG. 1 for a fuel injector according to a second embodiment of the invention.

In the embodiment of FIG. 2, the same numeral references are used for the same parts as in FIG. 1. Assembly 1 of this embodiment also includes a feeder unit 12 increasing to a relatively high pressure $P_2$ the pressure of fuel coming from source 2 at low pressure $P_1$. A connecting line 21 connects source 2 to unit 12. Assembly 1 also includes an amplifier unit 13 and a needle control unit 14 controlling a needle 15 which can be lifted to allow injection I of fuel into the combustion chamber of an engine. Units 12, 13 and 14 are integrated into a structural body 11 which can be mounted on the cylinder head of a combustion chamber. A check valve 121 is incorporated in a line 122 connecting the output of feeder unit 12 to a line 31 feeding a storage accumulator 3 connected, by another connecting line 32, to amplifier unit 13. Amplifier unit 13 increases the pressure of fuel coming from accumulator 3 to a high pressure $P_3$ and feeds needle control unit 14 via another connection line 182. A first servo-valve 16 is used to control the transfer of fuel from feeder unit 12 to accumulator 3 and amplification in amplifier unit 13. A second servo-valve 17 is used to drive needle control unit 14.

This embodiment shows that assembly 1 can be controlled with a small number of valves, i.e. two valves 16 and 17 instead of valve 16 and controllers $C_{12}$, $C_{13}$ and $C_{14}$ of the first embodiment. The control strategy is adapted to the use of valves 16 and 17 only.

Figure 3:
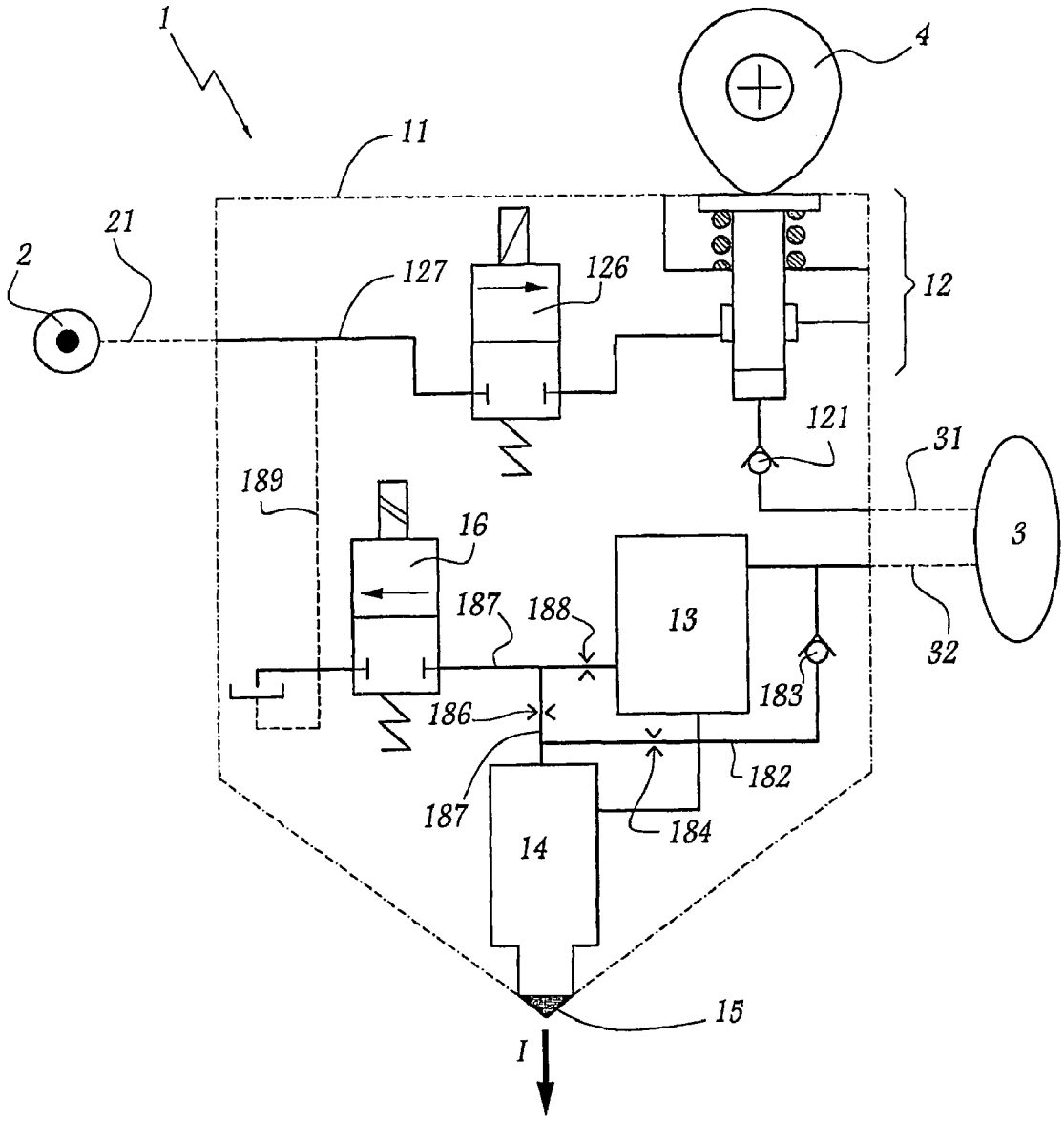
FIG. 3 is a flow diagram similar to FIG. 1 for a fuel injector assembly according to a third embodiment of the invention.
Figure 4:
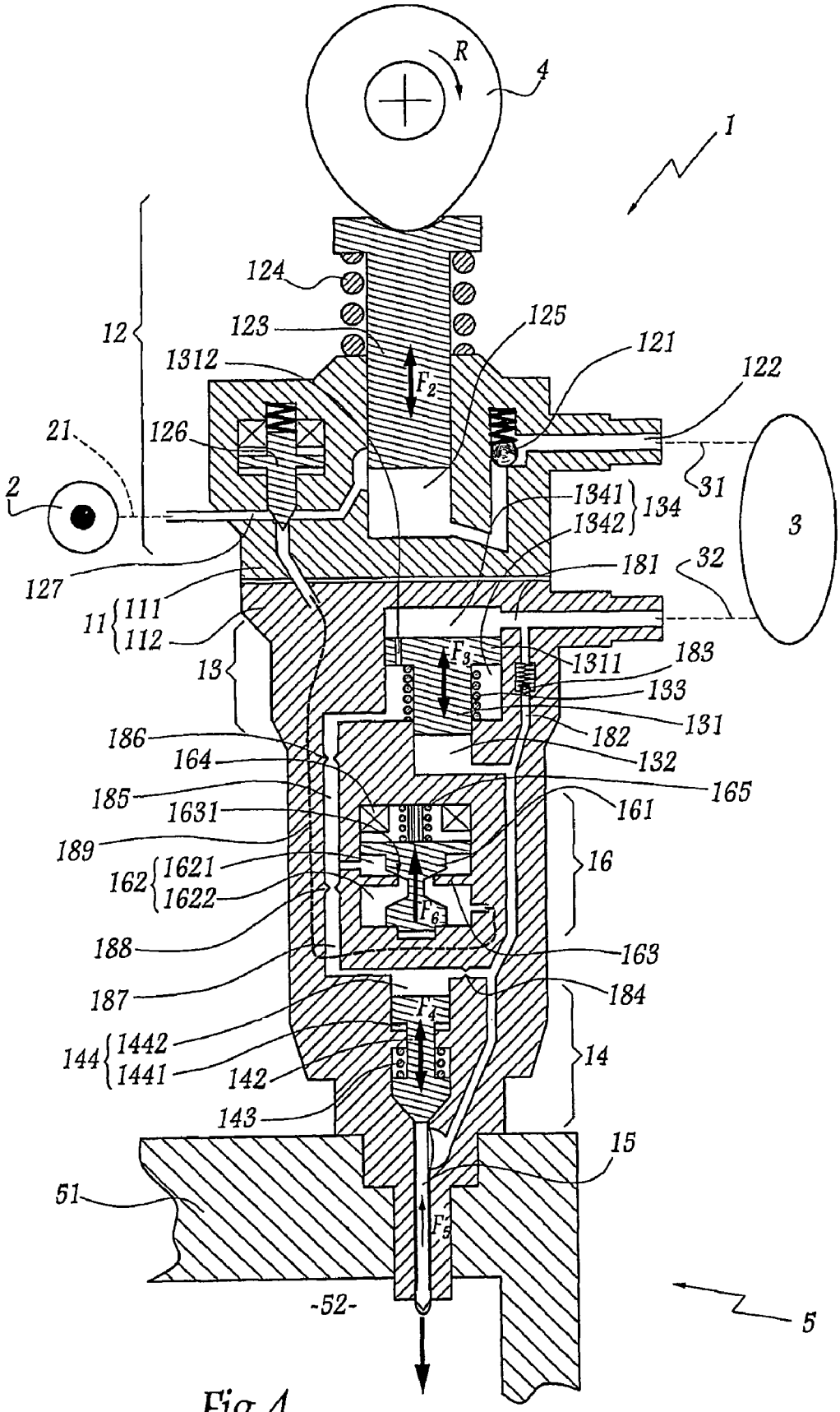
FIG. 4 is a schematic view representing the injector assembly of FIG. 3 mounted on an engine.
Figure 5:
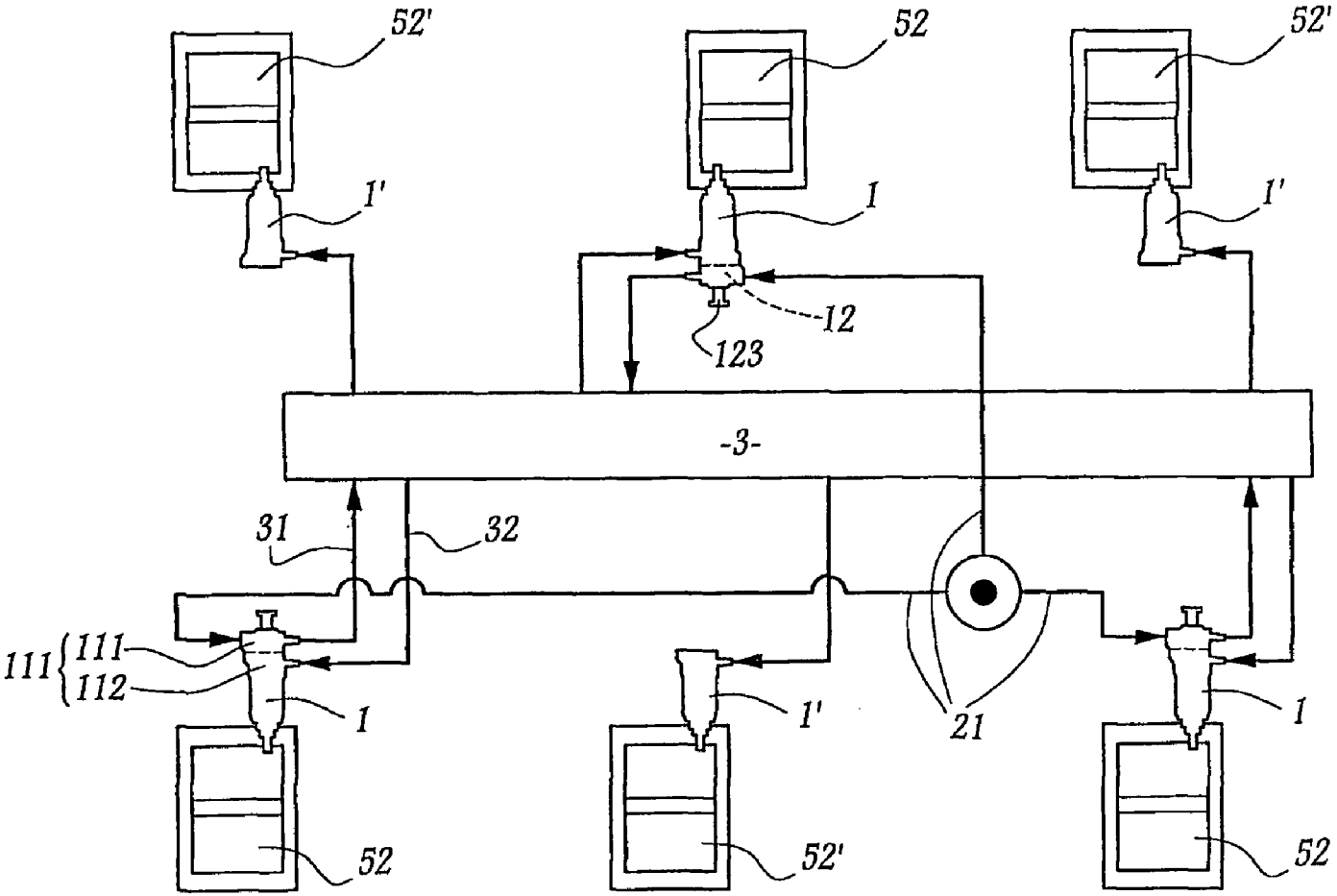
FIG. 5 is a schematic view showing an engine incorporating several fuel injector assemblies as the one of FIGS. 3 and 4.

In the embodiment of FIGS. 3 to 5, the same references as in the first embodiment are used for the same parts. Assembly 1 of this embodiment is built in a structural body 11 adapted to be mounted onto a cylinder head 51 of an engine 5. Assembly 1 includes a feeder unit 12 comprising a piston 123 driven by a crank shaft 4 of the engine 5 and loaded by a spring 124. This piston slides, with a back and forth movement represented by arrow $F_2$ on FIG. 4, within a volume 125 which is connected, on the one hand, to a source 2 of fuel at low pressure, preferably atmospheric pressure, and, on the other hand, to an accumulator 3 via a first connecting line 31. A servo-valve 126 is mounted on a feeding line 127 made in body 11 and fed by a line 21 coming from a source 2. Lines 21 and 127 connect source 2 to volume 125 and valve 126 controls the flow of fuel towards this volume. A check valve 121 is mounted in a line 122 connecting feeder unit 12 to line 31. Rotation R of the crank shaft 4 induces an alternative sliding movement $F_2$ of piston 123 within volume 125, which increases the pressure of fuel coming from source 2 to a predetermined level $P_2$. The pressure $P_2$ of fuel leaving unit 12 depends on the design of this unit.

Unit 12 and valves 121 and 126 are integrated in a first part 111 of body 11. In a second part 112 of body 11, are provided an amplifier unit 13 and a needle control unit 14 which are fed by accumulator 3 via a feeding line 32 and which are controlled by a single electromagnetic servo-valve 16.

Part 112 of body 11 is a basis part on which part 111 may be mounted or not, as explained hereafter.

Servo-valves 16, 17 and 126 of all embodiments are preferably electromagnetically driven.

Amplifier unit 13 includes a piston 131 sliding within a primary volume 132, as shown by arrow $F_3$, and loaded by a spring 133. A head 1311 of the piston 131 divides a secondary volume 134 into a first sub-volume 1341 and a second sub-volume 1342 connected by a restricted flow channel 1312 provided in the head 1311.

Needle control unit 14 drives a needle 15 fast with a piston 142 belonging to unit 14, loaded by a spring 143 and movable within a volume 144 divided into two sub-volumes 1441 and 1442. The sliding movement of piston 142 within volume 144 is represented by arrow $F_4$ on FIG. 4.

Servo-valve 16 includes a piston 161 movable within a volume 162 divided into two sub-volumes 1621 and 1622 by a wall 133. An electromagnet 164 can be actuated when the piston 161 must be pulled away from a seat 1631 defined by walls 163, against the action of a spring 165.

Connecting line 32 feeds a first connecting line 181, internal to part 112 and connected to sub-volume 1341, and a second connecting line 182, internal to part 112, including a check valve 183 and feeding itself both primary volume 132 and needle control unit 14. Connecting line 182 feeds sub-volume 1441 directly and sub-volume 1442 via a throttle 184. A third connecting line 185 connects sub-volume 1342 to sub-volume 1621, via a throttle 186. Finally, a fourth connecting line 187 connects sub-volume 1442 to sub-volume 1621, via another throttle 188.

When electromagnet 164 is not energized, piston 161 isolates sub-volume 1621 from sub-volume 1622 and all lines and internal volumes defined in part 112 of body 11, apart from sub-volume 1622, are fed with fuel at the pressure of accumulator 3, that is with fuel at a relatively high pressure, e.g. $10^8$ Pa.

If electromagnet 164 is energized, piston 161 is lifted with respect to seat 1631 in the direction of arrow $F_6$ and sub-volume 1342 is connected, via sub-volume 1622 and a connecting line 189 represented in dashed lines only, to a low pressure volume, e.g. the tank 2 of a vehicle. Therefore, pressure in sub-volume 1342 decreases. Because of the difference of pressure in sub-volumes 1341 and 1342, piston 131 moves, against the action of spring 133, which increases the pressure in primary volume 132. Therefore, fuel pressure in line 182 increases. No leak towards accumulator 3 is induced because of check valve 183.

On the other hand, sub-volume 1442 is also put into communication with low pressure tank 2, so that needle lift can occur as shown by arrow $F_5$, against the action of spring 143, because of the pressure difference between sub-volumes 1441 and 1442.

The response time of needle control unit 14 is determined by the sections of throttles 184 and 188. The response time of amplifier unit 3 with respect to the response time of unit 14 is determined by the section of throttle 186 with respect to sections of throttles 184 and 188. When the piston 142 and needle 15 are lifted, fuel under high pressure coming from volume 132 can be injected into the combustion chamber 52 of the engine, as shown by arrow I.

Therefore, an appropriate choice of cross section of the throttle means 184, 186 and 188 allows to control the injection rate of fuel under high pressure within combustion chamber 52. If the response time of unit 13 is lower than the response time of unit 14, injection starts at an intermediary pressure level, that is pressure of fuel coming from accumulator 3, and then injection goes on under high pressure, that is pressure generated by amplifier unit 13.

Once injection is to be terminated, electromagnet 164 is de-energized, so that piston 161 closes communication between sub-volumes 1621 and 1622, under the action of spring 165. Pressure within sub-volumes 1341 and 1342 comes to an equilibrium because of the communication through channel 1312, so that piston 131 moves upwards on FIG. 4, that is towards a position where primary volume 132 is increased. Simultaneously, spring 143 pushes piston 142 and needle 15 to a position where communication between line 182 and combustion chamber 52 is closed.

This fuel injector assembly allows a controlled delivery of fuel under pressure to the combustion chamber 52. This third embodiment is very effective and economical since a single control valve 16 is used to control both amplifier unit 13 and needle control unit 14.

As shown schematically on FIG. 5, each combustion chamber 52 of a six-cylinder diesel engine 5 can be equipped with a fuel injector assembly. Some assemblies 1 can be according to the third embodiment described here above, whereas the other assemblies 1' do not include a feeder unit 12. In fact, only the second part 112 of their body 11 is mounted onto the cylinder head 31 of some combustion chambers 52', whereas the body 11 of assemblies 1 is complete, with its parts 111 and 112.

As shown on FIG. 5, three complete fuel injector assemblies 1 can be used on three combustion chambers 52 and their respective feeding units 12 are used to feed a common rail accumulator 3 from a source of fuel at low pressure 2. Then, accumulator 3, which is preferably a common rail accumulator mounted on the cylinder heads 51 of engine 5, is used to feed the amplifier units 13 of all injector assemblies 1 or 1'. In other words, it is not compulsory that all fuel injector assemblies of a diesel engine include a feeder unit 12, since the feeder units 12 of some injector assemblies 1 might be sufficient to feed an accumulator 3 with fuel under pressure. Of course, an engine where all fuel injector assemblies are according to the invention can also be manufactured.

The invention has been represented in the third embodiment with an amplifier unit incorporating a piston. However, any kind of amplifier might be used. Similarly, any kind of needle control unit might be used with a fuel injector assembly according to the invention. Any kind of accumulator can be used instead of a common rail, e.g. holes drilled in the cylinder head or in the rocker arm. The invention has been represented in the second and third embodiments with feeder units incorporating a sliding piston. Other cam driven devices might be considered, such as cams with several lobes or various shapes since unit 12 is used to fill an accumulator, so that the flow out of this unit is not limited by desired flow rate at the level of the needle.

The upper part of the assembly, which includes feeder unit 12, can be oriented in any direction with respect to the lower part which includes units 13 and 14, depending on what is best for integration of assembly 1 on the engine. On FIG. 4, unit 12 and part 111 can be above or aside part 112 and the path of piston 123 can be vertical, horizontal or inclined.

Pressure generation with feeder unit 12 can be controlled with servo-valve 126 or, as an alternative, feeder unit 12 works constantly and a pressure regulator is incorporated into accumulator 3.

Any kind of control valve in any configuration might be used with a fuel injector assembly and an engine according to the invention.

A fuel injector assembly according to the invention can be used to retrofit an internal combustion engine. One does not need to implement a high pressure pump to feed an accumulator since one or several injector assemblies whose body 11 can be designed to fit onto the cylinder heads of the existing engine, can feed an accumulator.

The values of pressure mentioned in the description are given for illustrative purpose only and the invention is adapted to other pressures, provided that a relatively high pressure $P_2$ and a high pressure $P_3$ are used.

LIST OF REFERENCES

1 fuel injector assembly
1' fuel injector assembly
11 body
  111 first part
  112 second part
12 feeder unit
  121 check valve
  122 connecting line
  123 piston
  124 spring
  125 volume
  126 servo-valve
  127 connecting line
13 amplifier unit
  131 piston
    1311 head
    1312 channel
  132 primary volume
  133 spring
  134 secondary volume

1341 first sub-volume
1342 second sub-volume
14 needle control unit
142 piston
143 spring
144 volume
1441 first sub-volume
1442 second sub-volume
15 needle
16 servo-valve
161 piston
162 volume
1621 first sub-volume
1622 second sub-volume
163 wall
1631 seat
164 electromagnet
165 spring
17 servo-valve
181 connecting line
182 connecting line
183 check valve
184 throttle means
185 connecting line
186 throttle means
187 connecting line
188 throttle means
189 connecting line
2 source of fuel (tank)
21 connecting line
3 accumulator
31 connecting line
32 connecting line
4 crank shaft
5 engine
51 cylinder head
52 combustion chamber
I injection (arrow)
R rotation (arrow)
$F_2$ sliding movement (arrow) in 12
$F_3$ sliding movement (arrow) in 13
$F_4$ sliding movement (arrow) in 14
$F_5$ lift (arrow) in 15
$F_6$ lift (arrow) in 16
$P_1$ low pressure
$P_2$ relatively high pressure
$P_3$ high pressure
$C_{12}$ controller for unit 12
$C_{13}$ controller for unit 13
$C_{14}$ controller for unit 14

The invention claimed is:

1. A fuel injection assembly for injecting fuel into a combustion chamber of an internal combustion engine, said fuel injection assembly comprising:
a fuel injector;
a source which can provide fuel at relatively low pressure; and
an accumulator which can hold a quantity of fuel under pressure;
wherein the fuel injector comprises a needle and a needle control unit adapted to actuate the needle to deliver fuel to the combustion chamber; an amplifier unit adapted to increase the pressure of a quantity of fuel coming from the accumulator; and a cam-driven feeder unit adapted to feed the accumulator with fuel, received from the source, under pressure.

2. The fuel injection assembly according to claim 1, wherein said needle control unit, amplifier unit, and feeder unit are integrated in a structural body configured to be mounted onto a cylinder head of the engine.

3. The fuel injection assembly according to claim 2, wherein said structural body is divided into a first part including said feeder unit and a second part including said amplifier unit and said needle control unit.

4. The fuel injection assembly according to claim 1, wherein said feeder unit includes a piston adapted to be driven by a cam shaft of the engine and that slides within a volume that is connected, on the one hand, to the source and, on the other hand, to the accumulator.

5. The fuel injection assembly according to claim 4, wherein a control valve is interposed between the source and the volume.

6. The fuel injection assembly according to claim 1, wherein the amplifier unit includes a piston that slides within a primary volume that is connected to the accumulator and to the needle control unit.

7. The fuel injection assembly according to claim 6, wherein a control valve is connected to the amplifier unit and to the needle control unit and the control valve is adapted to control amplification in the amplifier unit and needle lift.

8. The fuel injection assembly according to claim 7, wherein the control valve is connected to the accumulator and to a secondary volume of the amplifier unit which is used to control sliding of the piston within the primary volume and wherein throttle means are located at least on one connecting line between the control valve and the accumulator or between the control valve and the secondary volume.

9. The fuel injection assembly according to claim 8, wherein throttle means are located on a connecting line between the control valve and the needle control unit.

10. The fuel injection assembly according to claim 7, wherein the control valve is integrated in a structural body that is configured to be mounted onto a cylinder head of the engine.

11. An internal combustion engine, comprising
at least one combustion chamber; and
a fuel injection assembly configured to inject fuel into the combustion chamber;
wherein the fuel injection assembly comprises
at least one fuel injector of a first type that is arranged to inject fuel into the combustion chamber;
a source which can provide fuel at relatively low pressure; and
an accumulator which can hold a quantity of fuel under pressure;
wherein the fuel injector of the first type comprises a needle and a needle control unit adapted to actuate the needle to deliver fuel to the combustion chamber; an amplifier unit adapted to increase the pressure of a quantity of fuel coming from the accumulator; and a cam-driven feeder unit adapted to feed the accumulator with fuel, received from the source, under pressure.

12. An internal combustion engine according to claim 11, wherein the internal combustion engine has a plurality of combustion chambers and wherein the fuel injection assembly further comprises at least one fuel injector of a second type that is arranged to inject fuel into one of the combustion chamber, which fuel injector of a second type includes a needle, a needle control unit, and an amplifier unit, but no feeder unit.

13. The internal combustion engine according to claim 12, wherein the accumulator is fed by the feeder unit(s) of the at least one fuel injector of the first type and wherein the accumulator is connected to the amplifier units of the fuel injectors of both the first type and the second type.

14. The internal combustion engine according to claim 13, wherein the at least one combustion chamber has a cylinder head associated with it and wherein the accumulator is formed by a rail that is mounted on the cylinder head.

15. An internal combustion engine, comprising:

a plurality of combustion chambers;

a fuel injector assembly associated with each of the combustion chambers for injecting fuel into the combustion chamber with which it is associated;

a common rail accumulator which can hold a quantity of fuel under pressure;

wherein each of the fuel injector assemblies comprises a needle and a needle control unit adapted to actuate the needle to deliver fuel, coming from the common rail accumulator, under pressure to the chamber with which the fuel injector is associated; and wherein some, but not all, of the fuel injector assemblies further comprise a cam-driven feeder unit adapted to feed the common rail accumulator with fuel received from a source that is able to provide fuel under relatively low pressure.

16. The internal combustion engine according to claim 15, wherein the internal combustion engine has a cylinder head and the common rail accumulator is mounted on the cylinder head.

17. The internal combustion engine according to claim 15 wherein, in the fuel injector assemblies that have a feeder unit, the needle control unit and the feeder unit are integrated in a structural body adapted to be mounted onto a combustion chamber cylinder head.

18. The internal combustion engine according to claim 17 wherein, in the fuel injector assemblies that have a feeder unit, the structural body is divided into a first part that includes the feeder unit and a second part that includes the needle control unit.

19. The internal combustion engine according to claim 15, wherein each of the feeder units includes a piston adapted to be driven by a cam shaft of the engine and that slides within a volume connected, on the one hand, to the source at low pressure and, on the other hand, to the accumulator.

20. The internal combustion engine according to claim 19, further comprising a control valve interposed between the source and said volume.

21. The internal combustion engine according to claim 15, wherein each fuel injector assembly includes an amplifier unit adapted to increase the pressure of a quantity of fuel received from the accumulator.

22. The internal combustion engine according to claim 18, wherein each fuel injector assembly includes an amplifier unit adapted to increase the pressure of a quantity of fuel received from the accumulator and the amplifier unit is included in the second part of the structural body.

23. The internal combustion engine according to claims 21, wherein each amplifier unit includes a piston that slides within a primary volume connected to the accumulator and to the needle control unit.

24. The internal combustion engine according to claim 23, further comprising a control valve that is connected to the amplifier unit and to the needle control unit and that is adapted to control amplification in the amplifier unit and needle lift.

25. The internal combustion engine according to claim 24, wherein the control valve is connected to the accumulator and to a secondary volume of the amplifier unit, which is used to control sliding of the piston within the primary volume; and wherein throttle means are located at least on one connecting line between the control valve and the accumulator or between the control valve and the secondary volume.

26. The internal combustion engine according to claim 25, wherein throttle means are located on a connecting line between the control valve and the needle control unit.

27. The internal combustion engine according to claim 18, wherein each of the feeder units includes a piston adapted to be driven by a cam shaft of the engine and that slides within a volume connected, on the one hand, to the source at low pressure and, on the other hand, to the accumulator;

wherein there is a control valve interposed between the source and the volume; and wherein the control valve is integrated in the structural body.

* * * * *